US007141008B2

(12) United States Patent
Krull et al.

(10) Patent No.: US 7,141,008 B2
(45) Date of Patent: Nov. 28, 2006

(54) ROWING MACHINE WITH ELLIPTICAL SEAT MOTION

(76) Inventors: Mark A. Krull, P.O. Box 7198, Bend, OR (US) 97708; Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 234 days.

(21) Appl. No.: 10/786,513

(22) Filed: Feb. 24, 2004

(65) Prior Publication Data

US 2005/0187073 A1 Aug. 25, 2005

(51) Int. Cl.
*A63B 22/04* (2006.01)
*A63B 22/00* (2006.01)

(52) U.S. Cl. ..... 482/70; 482/51

(58) Field of Classification Search ..... 482/51–53, 482/57, 70, 79–80, 72–73
See application file for complete search history.

(56) References Cited

U.S. PATENT DOCUMENTS

| | | | | | |
|---|---|---|---|---|---|
| 5,580,340 | A * | 12/1996 | Yu | ..... | 482/96 |
| 5,836,855 | A * | 11/1998 | Eschenbach | ..... | 482/57 |
| 5,876,308 | A * | 3/1999 | Jarvie | ..... | 482/51 |
| 6,017,295 | A * | 1/2000 | Eschenbach | ..... | 482/57 |
| 6,302,832 | B1 * | 10/2001 | Stearns | ..... | 482/96 |
| 6,409,635 | B1 * | 6/2002 | Maresh et al. | ..... | 482/57 |

* cited by examiner

*Primary Examiner*—Stephen R. Crow

(57) ABSTRACT

An elliptical motion rowing machine includes a frame, a linkage assembly movably mounted on the frame in such a manner that a portion of the linkage assembly moves through an elliptical path, and a seat mounted on that portion. A foot platform is preferably provided to support a person's feet, and handlebars are preferably provided to support a person's hands. The handlebars may be movably mounted on the frame, and may also be connected to the linkage assembly for synchronized movement with the seat.

23 Claims, 5 Drawing Sheets

ROWING MACHINE WITH ELLIPTICAL SEAT MOTION

FIELD OF THE INVENTION

The present invention relates to exercise methods and apparatus and in particular, to machines that simulate a rowing motion.

BACKGROUND OF THE INVENTION

Exercise equipment has been designed to generate a variety of exercise motions and/or to simulate a variety of exercise activities. For example, various machines have been designed to simulate rowing activity. Such machines typically include a seat that moves back and forth in reciprocal fashion. An object of the present invention is to provide a rowing machine having a seat that moves through an elliptical path of motion.

SUMMARY OF THE INVENTION

The present invention may be described in terms of a rowing machine having a seat that moves through an elliptical path of motion. Various different linkage arrangements may be used to generate the elliptical path. Many of the features and advantages of the present invention may become more apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

An exercise apparatus constructed according to the principles of the present invention is designated as 100 in FIGS. 1–4. The apparatus 100 may be described as an elliptical motion rowing machine having a frame 110, a linkage assembly movably mounted on the frame 110 in such a manner that a portion of the linkage assembly moves through an elliptical path, and a seat 144 mounted on that portion.

Figure 1:
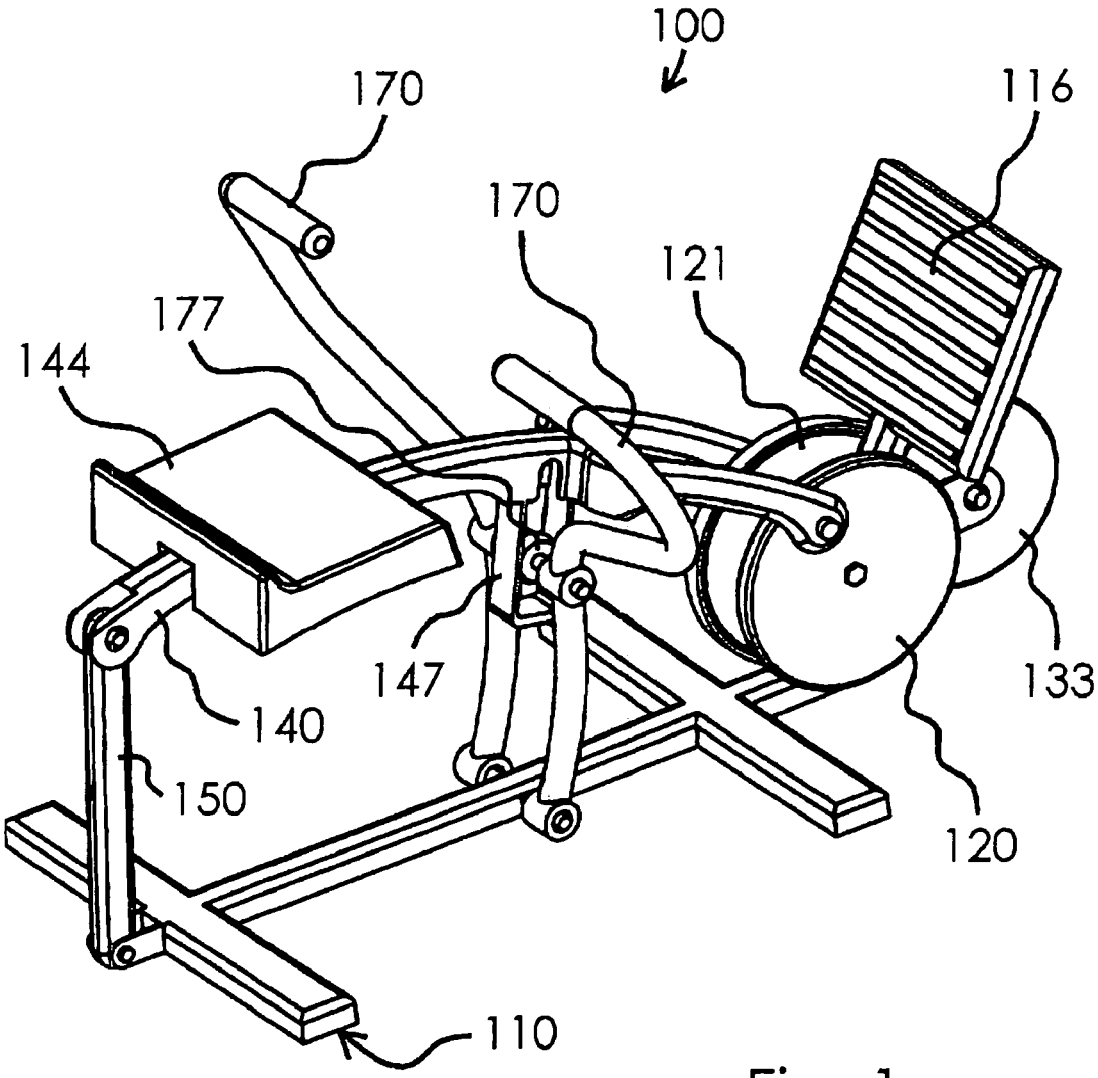
FIG. 1 is a perspective view of a rowing machine constructed according to the principles of the present invention.
Figure 2:
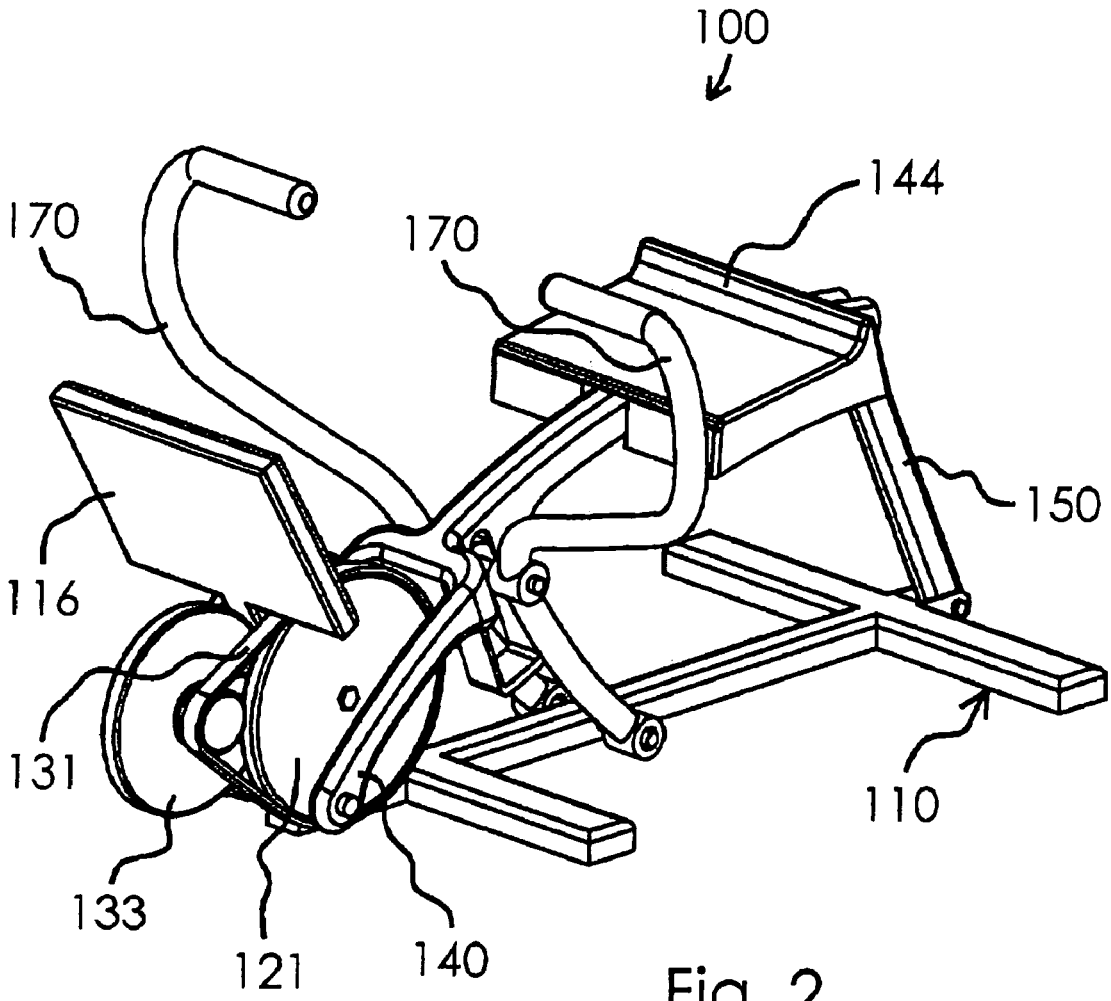
FIG. 2 is a generally opposite perspective view of the rowing machine of FIG. 1.
Figure 3:
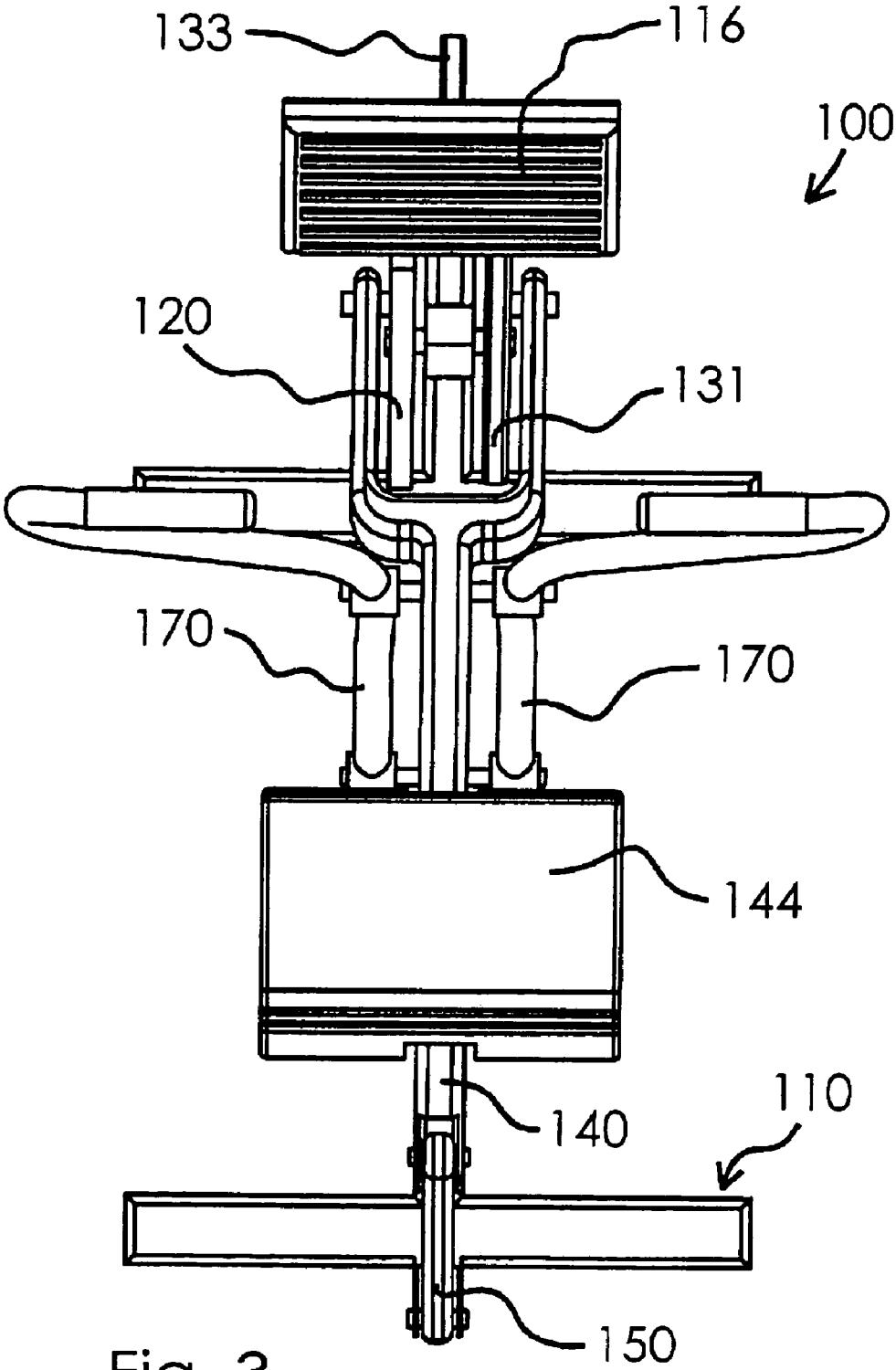
FIG. 3 is a top view of the rowing machine of FIG. 1.

The frame 110 includes a longitudinal member and front and rear transverse members that cooperate to form a stable base for resting on a floor surface. A foot platform 116 is mounted on the front end of the frame 110 to provide a foot receiving surface that is best seen in FIGS. 1 and 3. The foot platform 116 may be made selectively adjustable (by sliding and/or pivoting) relative to the frame 110 if desired.

A crank is rotatably mounted on the front end of the frame 110 in a manner known in the art. The crank may take various forms depending on design considerations, and is shown on the machine 100 as a rigidly interconnected pair of discs 120 and 121. One advantage of this arrangement is to prevent side loading on the bearings associated with the crank.

A flywheel 133 is also rotatably mounted on the front end of the frame 110 in a manner known in the art. The flywheel 133 is linked (in "stepped-up" fashion) to the crank disc 121 by a timing belt 131 or other suitable means known in the art. The arrangement is such that the flywheel 133 rotates many times faster than the crank discs 120 and 121. Any of various known resistance devices may be used in conjunction with the flywheel 133 to provide resistance to rotation of the crank discs 120 and 121.

A rocker link 150 is pivotally connected to a trunnion on the opposite, rear end of the frame 110. A connecting link or seat supporting link 140 is rotatably interconnected between the crank discs 120 and 121 and an upper end of the rocker link 150. The connecting link 140 has a forked front end that straddles the crank discs 120 and 121, and respective front ends are rotatably connected to respective discs 120 and 121. As a result of this arrangement, the front ends of the link 140 are constrained to move in circles relative to the frame 110; the rear end of the link 140 is constrained to move through an arc relative to the frame 110; and all intermediate points on the link 140 are constrained to move through respective elliptical paths relative to the frame 110.

Figure 4:
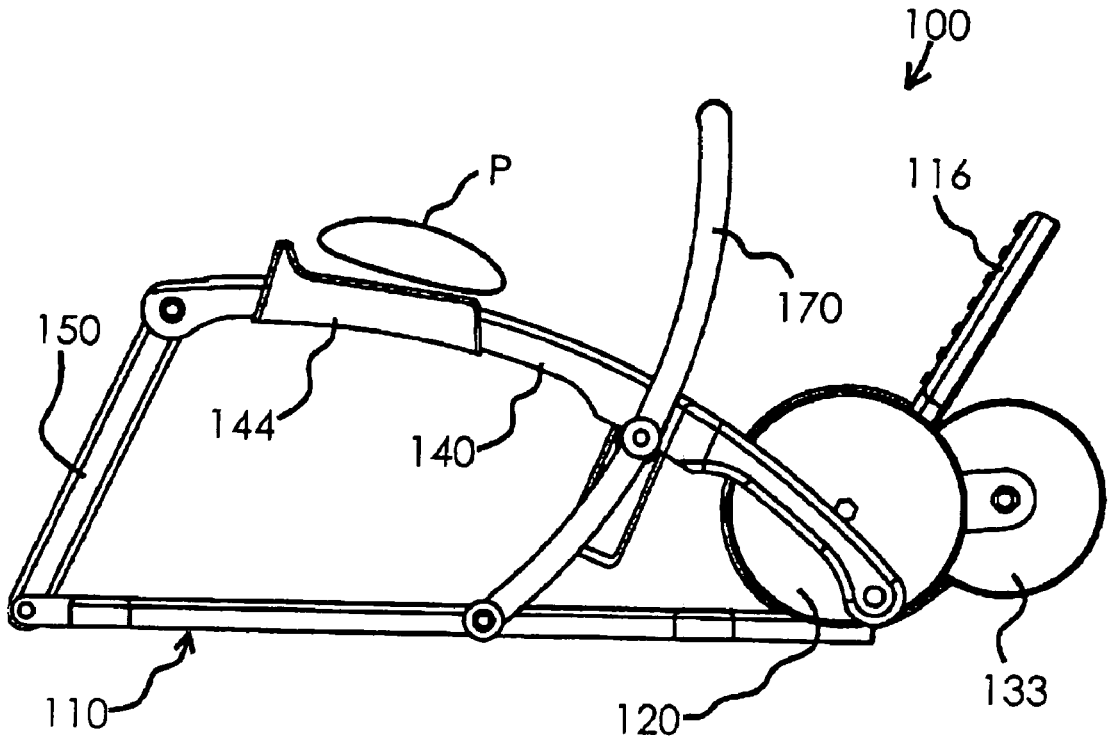
FIG. 4 is a side view of the rowing machine of FIG. 1.

A seat 144 is mounted on a rearward intermediate portion of the link 140. The seat 144 is sized and configured to support a person in a sitting position. As shown in FIG. 4, the seat 144 moves through a generally elliptical path P as the crank discs 120 and 121 rotate. Those skilled in the art will recognize that the elliptical path will have a relatively smaller minor axis as the tracing point moves closer to the rear rocker link 150, while the major axis will remain approximately the same.

On the machine 100, the seat 144 is rigidly secured to the link 140, but it may be movably mounted on the link 140 on alternative embodiments. For example, it may be desirable to selectively adjust the seat 144 along the link 140 to accommodate people of different sizes and/or to change the minor axis of the seat path. It may also be desirable to movably mount the seat 144 on the link 140 for movement along the link 140 during exercise activity.

The rocker link 150 and the connecting link 140 may be described collectively as a seat supporting linkage assembly connected to the seat 144 and movably interconnected between the crank discs 120 and 121 and the frame 110 in a manner that links rotation of the crank discs 120 and 121 to movement of the seat 144 through an elliptical path P; and/or as an interconnecting means for movably interconnecting the seat 144 between the crank discs 120 and 121 and the frame 110 in a manner that links rotation of the crank discs 120 and 121 to elliptical movement of the seat 144. Also, the rocker link 150, connecting link 140, and the crank discs 120 and 121 may be described collectively as a linkage assembly movably mounted on the frame 110 in such a manner that a seat supporting portion of the linkage assembly moves through an elliptical path P.

Left and right handlebars 170 have lower ends that are pivotally connected to an intermediate portion of the frame 110 at a common pivot axis. The handlebars 170 have opposite, upper ends that may be described as handles or hand grips sized and configured for grasping by a person sitting on the seat 144. The handlebars 170 have intermediate portions that are interconnected by a rigid bar on which a roller 177 is rotatably mounted. The roller 177 is disposed inside a guide or race 147 that extends downward from the link 140. This arrangement links movement of the link 140 (and rotation of the crank discs 120 and 121) to pivoting of the handlebars 170.

Figure 6:
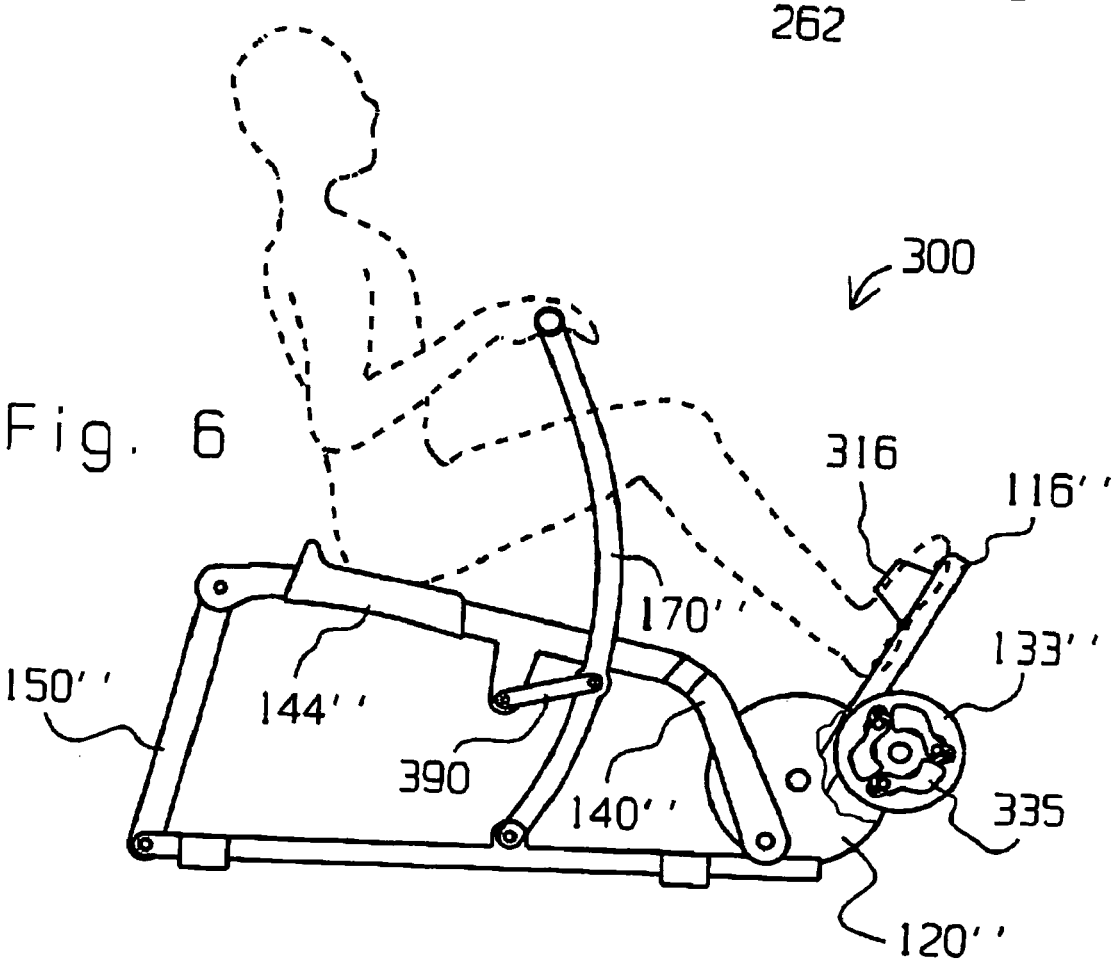
FIG. 6 is a side view of another alternative embodiment rowing machine constructed according to the principles of the present invention.

Those skilled in the art will recognize that the roller 177 may be replaced by a slide block or other suitable device. Also, the roller 177 and race 147 may be replaced by a telescoping member pivotally interconnected between the link 140 and the handlebars 170. Furthermore, FIG. 6 shows an alternative embodiment 300 having a rigid link 390 pivotally interconnected between an intermediate portion of the connector link 1401" and an intermediate portion of the handlebar 170".

Yet another, more extreme alternative is to replace the rigid handlebars 170 with a handlebar on the end of a cable or chain that is linked to the crank discs 120 and 121 by means of a one-way clutch (and also linked to a spring-return mechanism). The cable may be routed about one or more pulleys on the frame 110 (and/or the foot platform 116). Also, one or more such pulleys may be mounted on a spring-biased lever arm that moves during the application of force and thereby changes the mechanical advantage of tension in the cable contributing to rotation of the crank discs 120 and 121.

To use the machine 100, a person sits on the seat 144; places his feet on the foot platform 116; and grasps the handles in his hands. He then exerts force through the handlebars 170 and the foot platform 116 to move the seat 144 relative to the frame 110. Depending on factors such as the strength of the person, the starting position, and the inertial characteristics of the linkage assembly, the seat 144 may move reciprocally through a lower portion of the elliptical path P before "coming up and over center" and completing full revolutions. An advantage of the rigid handlebars 170 is that the person may push and pull to move the seat 144 in a desired direction. Those skilled in the art will also recognize that foot straps may be provided on the foot platform 116 to allow a person to pull, as well as push, with his legs. An example of such foot straps is designated as 316 on the machine 300 shown in FIG. 6.

Figure 5:
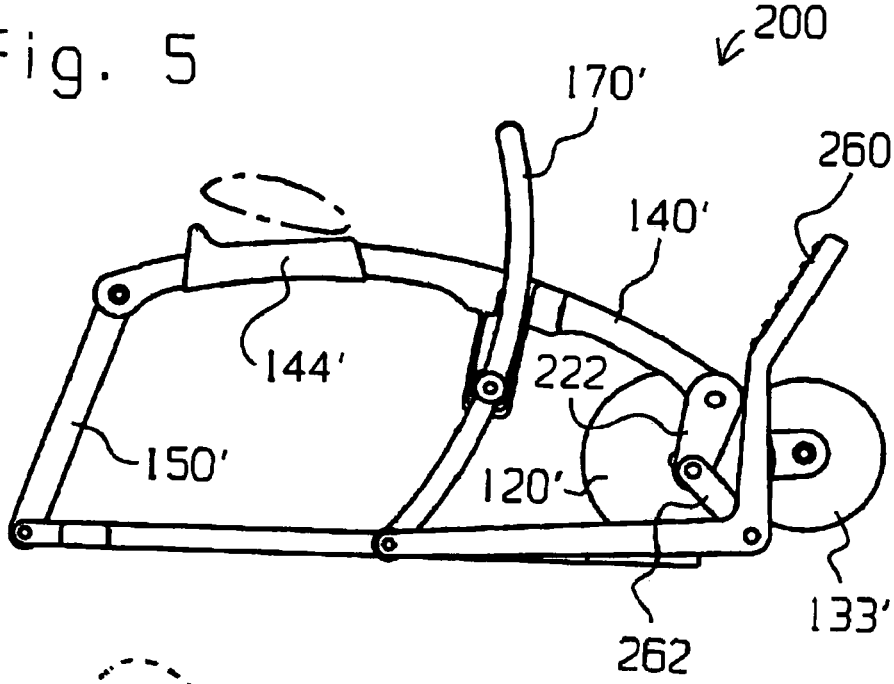
FIG. 5 is a side view of an alternative embodiment rowing machine constructed according to the principles of the present invention.

By pushing on the handlebars 170 and/or pulling against the foot straps 316 at the appropriate time, a person can encourage the seat 144 to move upward and forward over center, and thus, these components may be described as means for encouraging upward and forward movement of the seat. Various other "means" may be used to help a person get the seat 144 up and over center at the beginning of an exercise session. For example, FIG. 5 shows a foot platform link 260 having an upper, forward end that straddles the flywheel 133' to support a person's feet on respective sides of the flywheel 133'. An opposite, lower, rearward end of the foot platform link 260 is forked, and pivotally connected to respective sides of the frame at the same pivot axis as the handlebar 170'. Opposite, intermediate portions of the foot platform link 260 are pivotally connected to respective sinking crank links 262, which in turn, are pivotally connected to the cranks 120'. For purposes of operational clearance, a rigid crank extensions 222 are secured to respective cranks 120' at the pivot joints for the connector link 140', and extend to the pivot joints for respective sinking crank links 262. As a result of this arrangement, rotation of the cranks 120' is linked to pivoting of the foot platform 260, and a user may press against the upper end of the foot platform 260 to help move the seat 144 "over center" along its elliptical path.

Yet another way to facilitate "start-up" of the elliptical seat motion may be described with reference to the machine 300 shown in FIG. 6. In this regard, the machine 300 has a variable inertia flywheel 133" in place of the flywheel 133 on the first embodiment 100. The flywheel 133" has three pivotal eccentric weights 335 that are circumferentially spaced at equal intervals and biased toward the center by at least one spring. When the flywheel 133" is at rest, the weights 335 are relatively closer to the center of the flywheel 133", thereby making it relatively easy to initiate rotation of the flywheel 133". As the rotational speed of the flywheel 133" increases, the weights 335 pivot away from the center of the flywheel 133", thereby making it relatively more difficult to reduce the rotational velocity of the flywheel 133".

The present invention has been described with reference to particular embodiments, but it may be implemented in numerous other ways, as well. For example, many patents show how to generate elliptical motion for left and right foot supports. In fact, the linkage assembly arrangement on the machine 100 may be described as comparable to that disclosed in U.S. Pat. No. 4,185,622 to Swenson. It follows that alternative embodiments of the present invention may be constructed with linkage assembly arrangements or "interconnecting means" comparable to those disclosed in other patents for exercise machines with elliptical foot motion, including (but not limited to): U.S. Pat. No. 3,316,898 to Brown; U.S. Pat. No. 4,786,050 to Geschwender; U.S. Pat. Nos. 5,242,343, 5,518,473, and 5,562,574 to Miller; U.S. Pat. Nos. 5,729,529, 5,788,610, 5,823,919, 5,836,855, 5,913,751, 5,916,064, 5,921,894, 5,957,814, 5,993,359, 6,017,294, 6,024,676, 6,042,512, 6,045,488, 6,077,196, 6,077,198, 6,090,013, 6,090,014, 6,142,915, 6,168,552, 6,210,305, 6,409,632, 6,422,976, 6,422,977, 6,436,007, 6,440,042, and 6,482,132 to Eschenbach; U.S. Pat. Nos. 5,759,135, 5,759,136, 5,762,588, 5,779,599, 5,820,524, 5,823,914, and 5,823,917 to Chen; U.S. Pat. No. 5,989,159 to Chen et al.; U.S. Pat. Nos. 5,733,227, 5,746,683, 5,779,598, 5,860,895, 5,902,216, 5,971,892, 6,135,926, and 6,146,314 to Lee; U.S. Pat. No. 5,769,760 to Lin et al.; U.S. Pat. Nos. 6,149,551 and 6,190,289 to Pyles et al.; U.S. Pat. No. 5,830,112 to Wang et al.; U.S. Pat. Nos. 5,836,854, 5,846,166, 6,277,054, 6,450,925, and 6,454,682 to Kuo; U.S. Pat. No. 6,022,296 to Yu; U.S. Pat. No. 5,800,315 to Yu et al.; U.S. Pat. Nos. 5,803,872 and 5,865,712 to Chang; U.S. Pat. No. 6,206,806 to Chu; U.S. Pat. Nos. 5,916,065, 6,063,008, and 6,277,056 to McBride et al.; U.S. Pat. Nos. 6,123,650, 6,165,107, and 6,277,055 to Birrell; U.S. Pat. Nos. 5,899,833, 5,947,872, 6,099,439, and 6,176,814 to Ryan et al; U.S. Pat. No. 6,217,486 to Rosenow; U.S. Pat. Nos. 5,529,555, 5,540,637, 5,549,526, 5,573,480, 5,593,372, 5,611,758, 5,653,662, 5,690,589, 5,738,614, and 5,743,834 to Rodgers; U.S. Pat. No. 6,183,398 to Rufino et al.; and U.S. Pat. Nos. 5,707,321, 5,725,457, 5,792,026, 5,895,339, 5,919,118, 5,924,963, 5,938,568, 5,938,570, 5,997,445, 6,027,430, 6,077,197, 6,080,086, 6,126,574, 6,135,923, 6,196,948, 6,206,804, 6,312,362, 6,340,340, 6,579,210, 6,629,909, 6,648,801, and 6,689,020 to Stearns and/or Maresh, all of which are incorporated herein by reference together with the above-identified Swenson patent. Also, the present invention may be implemented with a user facing either direction in relation to a particular linkage assembly.

The present invention may also be described in terms of various methods which may be performed using the embodiments discussed above. For example, the subject invention may be described in terms of a method of exercise, comprising the steps of providing a frame; movably mounting a linkage assembly on the frame in such a manner that a portion of the assembly moves through an elliptical path; and mounting a seat on that portion.

Recognizing that this disclosure will enable persons skilled in the art to recognize various embodiments, modifications, and/or applications, the scope of the present invention is to be limited only to the extent of the claims which follow.

What is claimed is:

1. An exercise apparatus, comprising:

a frame designed to rest upon a floor surface;

a crank rotatably mounted on the frame;

a seat; and a seat supporting linkage assembly connected to the seat and movably interconnected between the crank and the frame in a manner that links rotation of the crank to movement of the seat through an elliptical path.

2. The exercise apparatus of claim 1, further comprising at least one foot support mounted on the frame in a manner that provides a foot receiving surface facing toward the seat.

3. The exercise apparatus of claim 1, further comprising at least one handlebar movably mounted on the frame, and having a hand grip portion disposed within reach of a person sitting on the seat.

4. The exercise apparatus of claim 3, wherein the handlebar is pivotally mounted on the frame and connected to the linkage assembly in a, manner that, links rotation of the crank to pivoting of the handlebar.

5. The exercise apparatus of claim 1, wherein the linkage assembly includes a rocker link pivotally mounted on the frame, and a seat supporting link movably interconnected between the rocker link and the crank.

6. An exercise apparatus, comprising:

a frame designed to rest upon a floor surface;

a crank rotatably mounted on the frame;

a seat; and an interconnecting means for movably interconnecting the seat between the crank and the frame in a manner that links rotation of the crank to elliptical movement of the seat.

7. The exercise apparatus of claim 6, further comprising at least one foot support mounted on the frame in a manner that provides a foot receiving surface facing toward the seat.

8. The exercise apparatus of claim 6, further comprising at least one handlebar movably mounted on the frame, and having a hand grip portion disposed within reach of a person sitting on the seat.

9. The exercise apparatus of claim 8, wherein the handlebar is pivotally mounted on the frame and connected to the interconnecting means in a manner that links rotation of the crank to pivoting of the handlebar.

10. The exercise apparatus of claim 6, wherein the interconnecting means includes a rocker link pivotally mounted on the frame, and a seat supporting link movably interconnected between the rocker link and the crank.

11. An elliptical motion rowing machine, comprising:

a frame;

a linkage assembly movably mounted on the frame in such a manner that a portion of the linkage assently moves through an elliptical path; and a seat mounted on the portion, thereby defining at least one point of overlap that moves through an elliptical path.

12. The exercise apparatus of claim 11, further comprising at least one foot support mounted on the frame in a manner that provides a foot receiving surface facing toward the seat.

13. The exercise apparatus of claim 11, further comprising at least one handlebar movably mounted on the frame, and having a hand grip portion disposed within reach of a person sitting on the seat.

14. The exercise apparatus of claim 13, wherein the handlebar is pivotally mounted on the frame and connected to the linkage assembly in a manner that links rotation of the crank to pivoting of the handlebar.

15. The exercise apparatus of claim 11, wherein the linkage assembly includes a rocker link pivotally mounted on the frame, a crank rotatably mounted on the frame, and a seat supporting link movably interconnected between the rocker link and the crank.

16. On an exercise rowing machine of a type having a seat movably mounted on a frame, the improvement comprising an elliptical motion linkage assembly interconnected between the seat and the frame in a manner that guides at least a portion of the seat through an elliptical path of motion.

17. An elliptical motion rowing machine, consisting essentially of:

a frame;

a crank rotatably mounted on the frame;

a rocker link pivotally mounted on the frame;

a connecting link movably interconnected between the rocker link and the crank in such a manner that a portion of the connecting link moves through an elliptical path;

a seat mounted on said portion thereby defining at least one point of interconnection that moves through an elliptical path; and a foot platform mounted on the frame forward of the seat.

18. The elliptical motion rowing machine of claim 17, further comprising a handle movably connected to the frame.

19. The elliptical motion rowing machine of claim 18, wherein the handle is linked to the crank.

20. The elliptical motion rowing machine of claim 19, wherein the handle is part of a rigid bar that is pivotally mounted on the frame and connected to the connecting link.

21. The elliptical motion rowing machine of claim 17, wherein the foot platform is movably connected to the frame.

22. The elliptical motion rowing machine of claim 21, wherein the foot platform movably connected to the crank.

23. The elliptical motion rowing machine of claim 17, further comprising force receiving means for receiving user supplied force to facilitate over center movement of the seat.

* * * * *